United States Patent [19]

Denison et al.

[11] Patent Number: 4,557,332

[45] Date of Patent: Dec. 10, 1985

[54] DRILLING RISER LOCKING APPARATUS AND METHOD

[75] Inventors: Early B. Denison, Houston; Jean-Claude M. Picard, Victoria, both of Tex.

[73] Assignee: Shell Offshore Inc., Houston, Tex.

[21] Appl. No.: 597,995

[22] Filed: Apr. 9, 1984

[51] Int. Cl.[4] ..... E21B 7/128

[52] U.S. Cl. ..... 166/345; 166/355; 166/359; 166/902

[58] Field of Search ..... 166/345, 341, 359, 352–355, 166/362, 367; 285/24, 26

[56] References Cited

U.S. PATENT DOCUMENTS

| | | | |
|---|---|---|---|
| 3,717,002 | 2/1973 | O'Brien et al. | 166/345 |
| 3,722,584 | 3/1973 | Nelson | 166/345 |
| 3,895,677 | 7/1975 | Bokenkamp | 166/359 |
| 4,014,567 | 3/1977 | Arnold et al. | 285/24 |
| 4,428,433 | 1/1984 | Watkins | 166/339 |

*Primary Examiner*—James A. Leppink
*Assistant Examiner*—Hoang C. Dang

[57] ABSTRACT

Method and apparatus for use in drilling a well from a floating vessel by means of a riser, which connects the vessels drilling equipment to a wellhead assembly adjacent the ocean floor. The riser is capable of being disconnected from the wellhead assembly, and having its upper end locked to the vessel. The present riser locking apparatus is made up of selectively-positionable resiliently-moveable locking beams adapted to be remotely actuated to lock the upper elements of the riser to the vessel, thereby preventing lateral or vertical movement of the riser relative to the vessel.

35 Claims, 11 Drawing Figures

DRILLING RISER LOCKING APPARATUS AND METHOD

RELATED APPLICATION

This application is related to a co-pending application entitled "Drilling Riser Locking Apparatus and Method", Ser. No. 597,994; filed Apr. 9, 1984.

BACKGROUND OF THE INVENTION

1. Field of the Invention

The present invention is directed to apparatus and method for drilling a well into earth formations lying below a body of water, wherein the wellhead equipment of the well is postioned below the surface of the water. The well is drilled from a floating drilling vessel, with a riser conduit connecting the vessel drilling equipment to the wellhead assembly.

2. Description of the Prior Art

An increasing amount of offshore deepwater exploratory well drilling is being conducted in an attempt to locate oil and gas reservoirs. These exploratory wells are generally drilled from floating vessels. As in any drilling operation, drilling fluid must be circulated through the drill bit in order to cool the bit and to carry away the cuttings. This drilling fluid is normally returned to the floating vessel by means of a large diameter pipe, known as a riser, which extends between the subsea wellhead assembly and the floating vessel. The lower end of this riser is connected to the wellhead assembly which is generally adjacent to the ocean floor, and the upper end usually extends through a centrally located hull opening of the floating vessel. A drillstring extends downward through the riser into earth formations lying below the body of water, and drilling fluids circulate downwardly through the drillstring, out through the drilling bit, and then upwardly through the annular space between the drillstring and riser, returning to the vessel.

As the water depths for these drilling operations continue to increase, the length of the riser and subsequently its unsupported weight also increases. Since the riser has the same structural buckling characteristics as a vertical column, riser structural failure may result if compressive stresses in the elements of the riser exceed the metallugical limitations of the riser material. Two separate mechanisms are typically used to avoid the possibility of this cause of riser failure.

Riser tensioning systems are installed on board the vessel, which apply an upward force to the upper end of the riser, usually by means of cable and sheave mechanisms connected between the vessel and the upper elements of the riser.

Buoyancy or ballasting means may also be attached to the submerged portion of the riser. These usually are comprised of syntactic foam or individual ballast tanks formed on the outer elements of the riser section. The ballest tanks are capable of being selectively inflated with air from the floating vessels air compression equipment. Both of these buoyancy devices create upwardly directed forces in the riser, compensating for the compressive stresses created by the risers weight, and thereby preventing riser failure.

Since the riser is fixedly secured at its lower end to the wellhead assembly, the floating vessel will move relative to the upper end of the riser due to wind, wave, and tide oscillations normally encountered in the marine environment.

This creates a problem because the stationary riser located within the hull opening of the oscillating vessel can contact and damage the vessel, unless it remains safely positioned within the hull opening. For this reason motion compensating equipment incorporated with the riser tensioning system used to steady the riser within the hull opening, and usually takes the form of hydraulically actuated cable and sheave mechanisms connectably engaged between the upper riser elements and the vessel structure, and a flexible coupling located in the riser adjacent the vessel's hull. This equipment allows the vessel to heave, surge, and sway without contacting the upper elements of the riser.

Directional positioning thrusters, in addition to the normal maneuvering system of the vessel, compensate for normal current and wind loading, and prevent riser separation due to the vessel being pushed away from the wellhead location.

All of these systems, however, can only prevent riser compressive failure, separation, or contact with the vessel during normal sea state conditions.

The capacity of these systems is exceeded with winds typically over 35 to 40 mph and/or swells over a height of 25 feet. Above these values, further measures need to be taken, to prevent riser and vessel damage.

The riser may be disassembled in sections and stowed on the floating vessel's deck, but the time required for this operation usually exceeds the warning time given by an oncoming storm system.

The riser may be disconnected from the wellhead assembly and thereby become suspended from the vessel. The vessel with the suspended riser then may remain in the vicinity of the wellhead assembly, or the vessel may attempt to tow the riser out of the path of an approaching storm. In either situation, once the riser's lower element is released from the wellhead assembly, the riser becomes a vertically orientated submerged vessel with its own oscillatory characteristics, or "bobbing" tendencies, typically different than those of the supporting vessel. When the vessel and riser heave upward, due to the vessel riding the crest of the wave, the riser may continue upwards while the vessel is falling downwards in a subsequent wave trough. This uncontrolled upward riser movement and subsequent downward movement through the center of the hull opening can exceed the allowable vertical movement and load capacity of the normal motion compensating and tensioning equipment, causing severe damage to the vessel and riser, with attendant risk to crew and vessel.

As described in a copending application entitled "Drilling Riser Locking Apparatus and Method", Ser. No. 597,994, filed Apr. 9, 1984, apparatus is disclosed which locks the upper end of the drilling riser to the vessel. This eliminates the downward, and lateral movement of the riser relative to the vessel, obviating the above problem. The disclosed apparatus is comprised of riser locking apparatus carried within the hull opening of the floating vessel, adjacent the bottom of the vessel. The riser locking apparatus is carried at this lower elevation so that the angular displacement of the riser at its upper flexible coupling will not cause the riser, in its displaced position, to contact and damage the vessel's hull. The riser locking apparatus disclosed in the copending application comprises a pair of moveable beams that can be moved towards each other, at the closest point of travel engaging the upper elements of the riser. Locking these beams in their closed position effectively locks the riser's upper end to the vessel. Riser positioning means are also provided to precisely position the riser between the moveable locking beams prior to closure of these beams.

In some circumstances, it is preferred that the riser be held stationary between the two moveable locking beams prior to their closure against the riser so as to allow the moveable locking beams' and the riser's landing areas to properly engage with one another. The time required for this riser locking operation may not be available prior to onset of a sudden storm.

The improvement over previous apparatuses allows quicker coupling and locking of the riser to the moveable locking beams.

SUMMARY OF THE INVENTION

The present apparatus allows the riser to be pulled through two moveable locking beams, where the beams are initially closely positioned to each other. As the riser and moveable locking beams landing areas initially contact one another in sliding engagement during vertical movement of the riser between the beams, the moveable locking beams resiliently recede or are forced apart from their original side by side position, and follow the contour of the landing areas contacting the riser. When the riser reaches the final latching position, the moveable locking beams close fully about or against the riser, returning to or toward their previous side by side position. This action allows the riser to be quickly latched and locked to the vessel during unfavorable combinations of vessel and riser movement, without the delays that would be necessary if the riser had to be precisely positioned with respect to the locking beams.

As a further feature, the riser positioning means no long need to precisely position the riser between the moveable locking beams prior to their closure, but only need to approximately center the riser between the beams prior to the riser's vertical displacement through the beams.

This invention may be used to safely transport the riser away from the current drilling location in order to avoid a marine storm environment, it may be used to transport the riser from one wellhead assembly to another prior to performing normal drilling operations, it may be used during maintenance operations on the vessel's motion compensating and riser tensioning equipment, or it may be used to suspend the riser from the vessel for an indeterminate length of time.

Accordingly, it is an object of the invention to provide an offshore vessel with riser locking apparatus to securely lock the upper end of the riser to the vessel during any sea-state conditions thereby preventing relative motion between the upper end of a suspended riser and the vessel. This riser locking apparatus includes movable locking beams that resiliently respond to the contact with the riser's landing areas in order to allow latching and locking of the riser as it is vertically displaced between the closely positioned moveable locking beams, supporting tracks for these beams, and related beam locking methods.

Another object is to provide an offshore drilling vessel with means to transport a riser from one location to another in a safe manner during normal or inclement weather conditions, or to allow the maintainence and repair of the normal riser support mechanisms.

A further object of the invention is to provide a riser locking apparatus which is simple in design, rugged in construction, and economical to manufacture.

The various features of novelty which characterize the invention are pointed out with particularity in the claims next to and forming a part of this disclosure. For a better understanding of the invention, its operating advantages and specific object obtained by its uses, reference should be made to the accompanying drawing and descriptive matter in which there are illustrated preferred embodiments of the invention.

The latching and locking sequence of the riser to the moveable locking beams, can be envisioned by sequentially viewing drawings 7C, 7B, and 7A.

Figure 6:
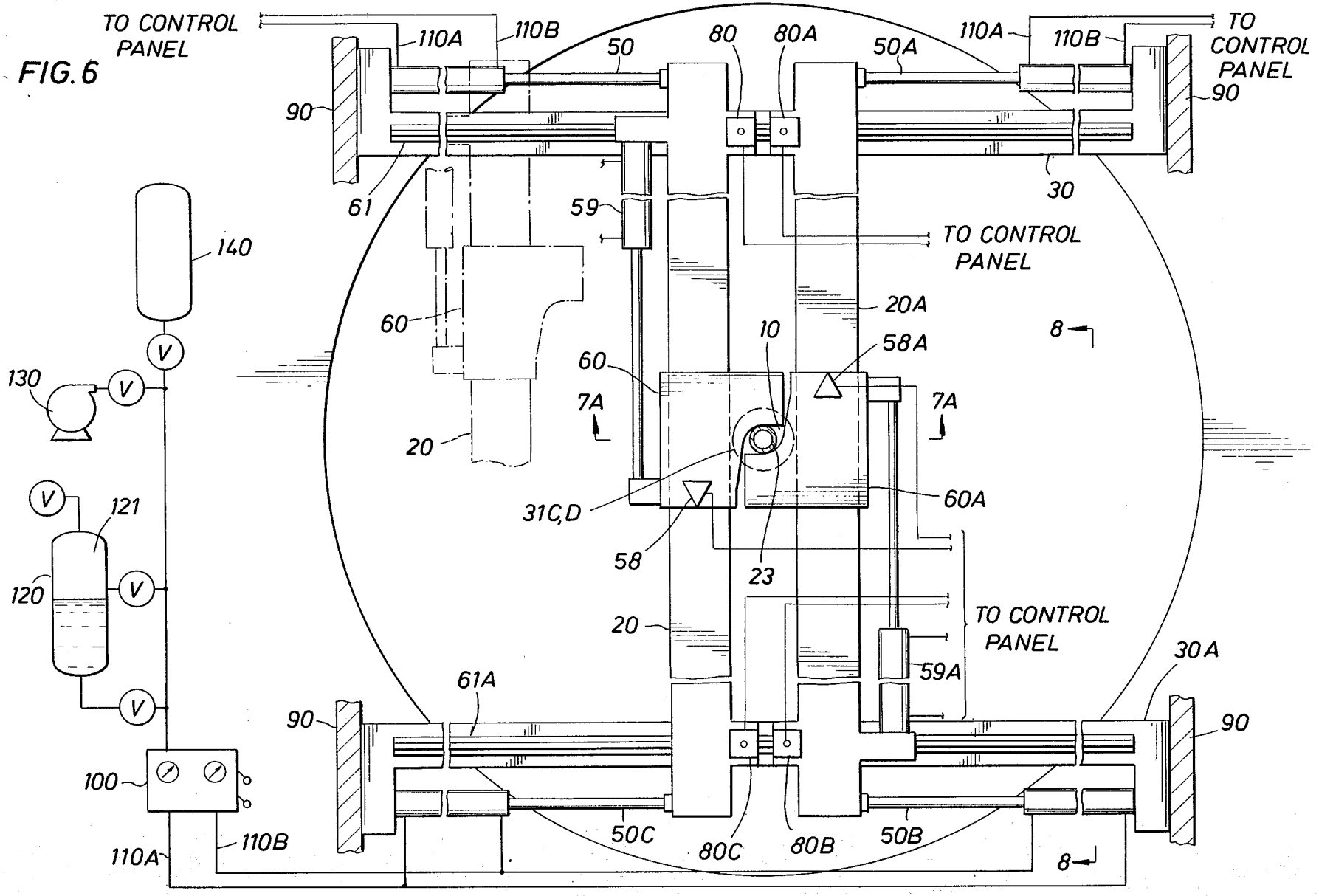
FIG. 6 is a plan view of the riser locking apparatus of the present invention shown in place in the centrally located hull opening of a floating vessel.
Figure 8:
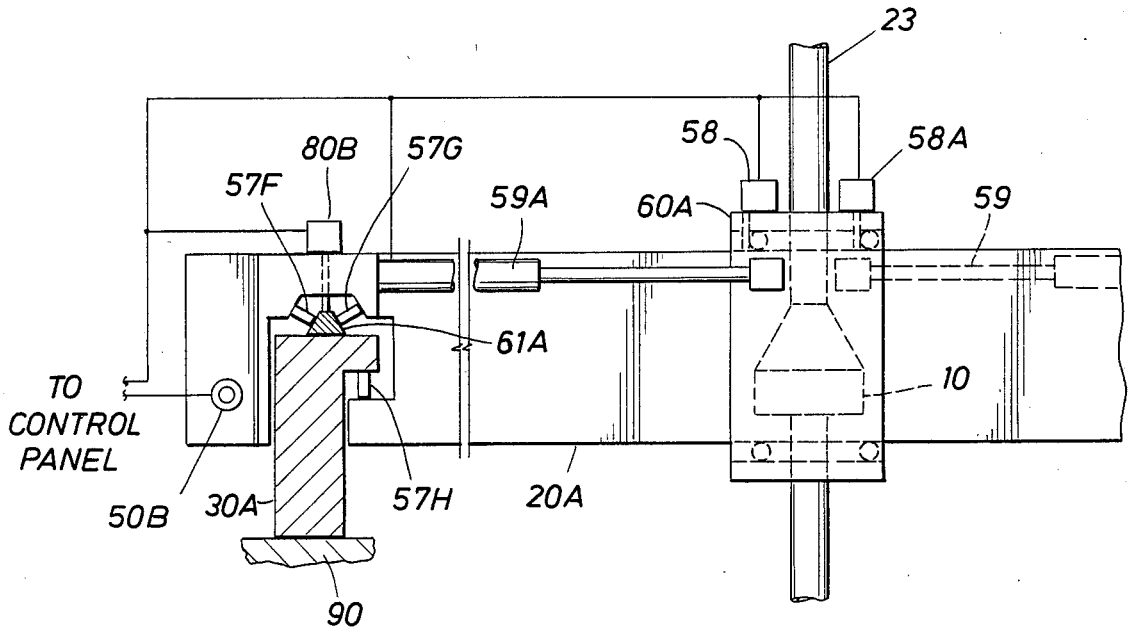

FIG. 8 is a schematic partial view in cross section taken along lines 8—8 of FIG. 6 further illustrating the movable locking beams and the track means.

DESCRIPTION OF THE PREFERRED EMBODIMENT

Figure 1:
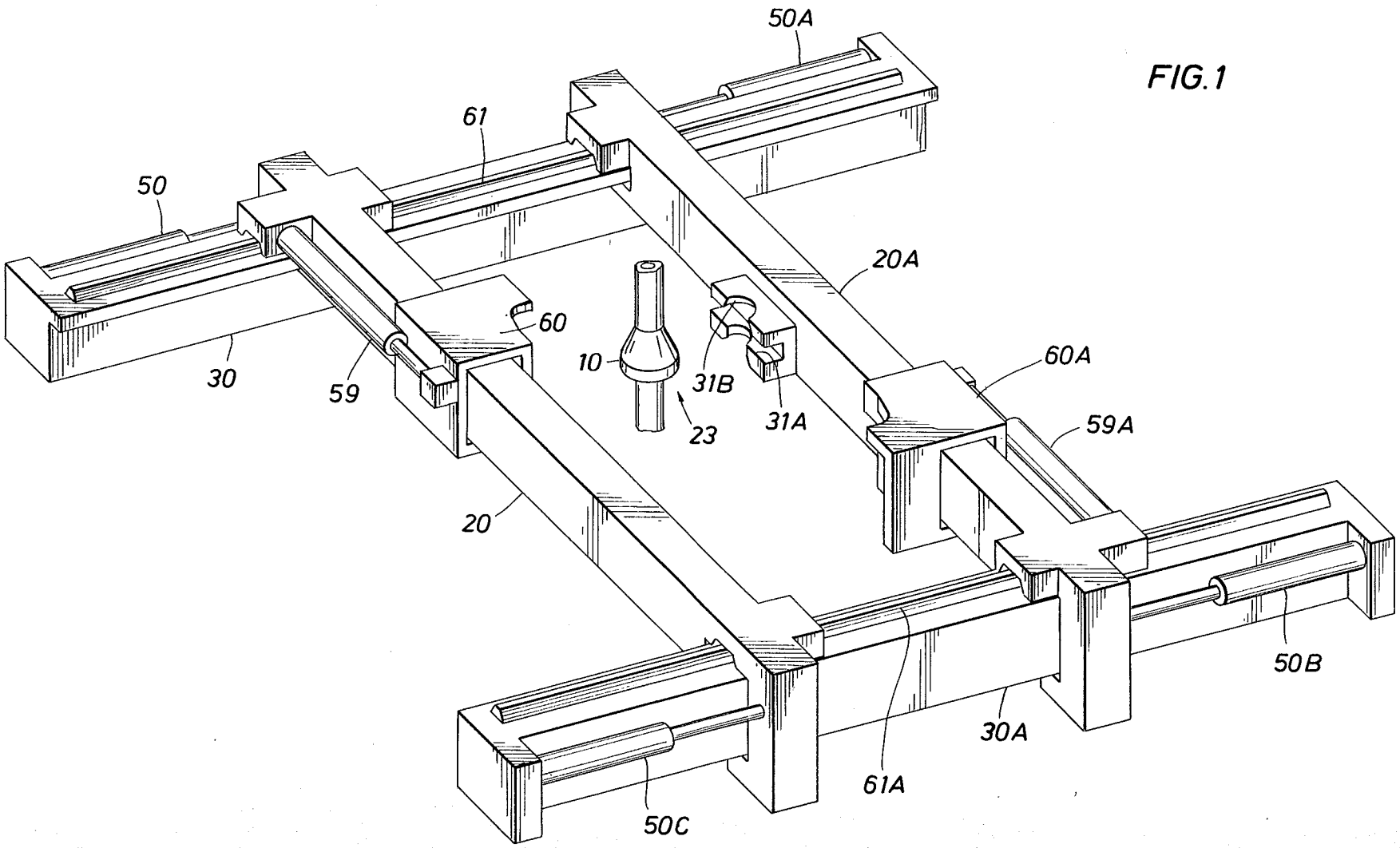
FIG. 1 is a diagramatic isometric view of the generalized riser positioning apparatus, with a riser shown positioned between two moveable locking beams.

FIG. 1 is a simplified isometric representation of the riser locking apparatus. Track means, which may include two parallel tracks 30 and 30A, support at least a pair of moveable locking beams 20, 20A. Riser positioning means which may be in the form of independent slides 60, 60A are slideably engaged with a pair of moveable locking beams 20, 20A, and assist in locating the riser 23 adjacent landing areas 31A, 31B formed on or secured to beam 20A, as illustrated. It is understood that additional landing areas 31C, 31D (FIG. 2) formed or installed on moveable locking beam 20 are similar to the landing areas 31A, 31B, but are not shown due to the perspective of the drawing. First prime mover means 59, 59A are arranged to move the riser positioning means 60 and 60A, respectively, toward and away from the landing areas 31A, 31B, 31C, 31D, while second prime mover means 50, 50A, 50B, 50C are provided with driving means and are connected between the vessel and the beams 20 and 20A to move the moveable locking beams 20 and 20A toward and away from each other. Both of these prime mover means may take the form of pistons and cylinders, as is well known to the art.

In operation, the moveable locking beams 20, 20A are placed side by side each other, while the riser positioning means 60, 60A assist in locating the riser 23 adjacent the landing areas 31A, 31B, and co-operating landing areas 31C, 31D (not shown). The riser 23 is then moved vertically through the landing areas 31A, 31B, (31C, 31D not shown), until the riser stop means 10 fully contacts and latches with the landing areas 31A, 31B (31C, 31D not shown). The riser stop means 10 is shaped as a mating profile to latch with and to be supported by landing areas 31A, 31B, (31C, 31D not shown). The mating engagement of landing areas 31A, 31B, (31C, 31D not shown) with the riser stop means 10 is such that movement of the riser 23 within the hull opening is prevented. It is recognized that other mechanically equivalent profiles may be used, as shown in FIG. 7D, that would accomplish the same results as discussed above.

The moveable locking beams 20, 20A are resiliently forced apart following contact with the mating profile of the riser stop means 10 as the riser 23 is moved vertically between the beams. This resilient response is accomplished by incorporating resilient spring means such as a coil spring 51 (FIG. 7C) in the second prime mover means 50, 50A, 50B, 50C connection to the moveable locking beams 20, 20A, as is well known to the art, or by incorporating a hydraulic accumulator 120 partially filled with a resilient gas 121 within the pressure source applied to the second prime mover means 50, 50A, 50B, 50C, (FIG. 7B) as is well known to the art. It is recognized that other resilient means may be used to accomplish the same mechanical effect.

Figure 2:
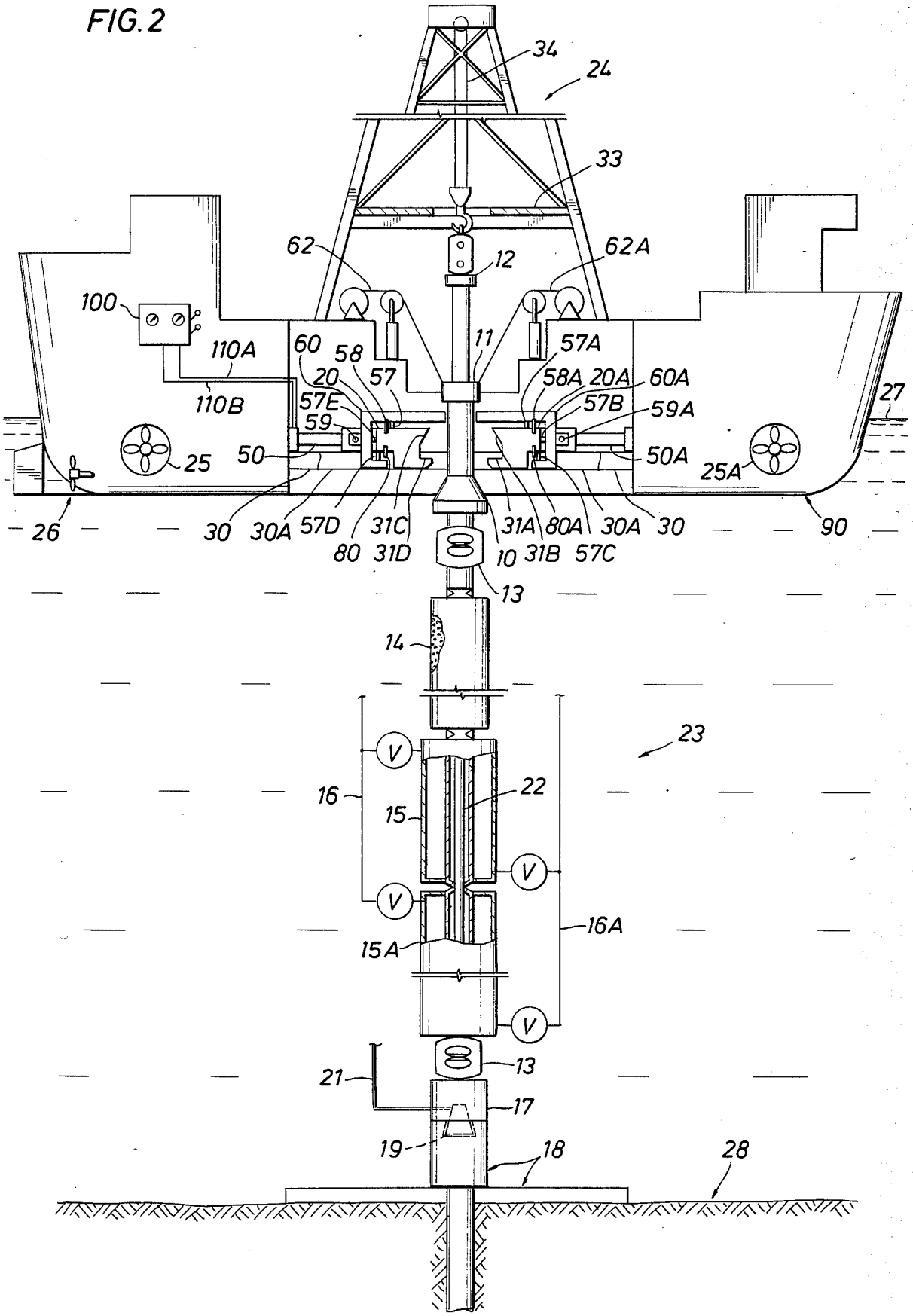
FIG. 2 is a schematic representation of an underwater drilling operation in which a riser according to the present invention, is shown connected between a floating vessel and a subsea wellhead assembly.

Once the riser stop means 10 is securely latched between the moveable locking beams 20, 20A, the beams 20, 20A, are locked to the tracks 30, 30A, by locking devices well known to the art, such as by pins, 80, 80A (FIG. 2).

FIG. 2 shows an offshore drilling vessel 90 floating in a body of water 27 above the ocean floor 28 with a riser 23 connected between the ocean floor 28 and the riser motion compensating and tensioning means 62, 62A of the vessel 90. The motion compensation and tensioning apparatus 62, 62A, which is well known to the art, allows the riser 23 to move vertically in a controlled manner within the centrally positioned hull opening of the vessel 90 and also applies an upward force to the riser 23 in order to prevent buckling of the riser 23. Personnel positioned on the derrick room floor 33 conduct drilling operations through the riser 23 down to the subsea formation located beneath the ocean floor 28, utilizing the drill string and riser lifting mechanism 34. The motion of the vessel 90 relative to the riser 23 upper elements is compensated by means of a riser inner barrel 12 which telescopically moves within the riser outer barrel 11. This movement allows the drilling operations from the derrick room floor 33 to proceed at a varying elevation from the ocean floor 28. The riser inner barrel 12 may be fully extended by upward movement of the drill string and riser lifting mechanism 34. In this fully extended position lifting forces may be applied to the upper end of the riser 23, in order to raise the riser 23 within the vessel 90.

Positioned below the riser outer barrel 11 is the riser stop means 10. When the riser stop means 10 is securely latched and locked to moveable locking beams 20, 20A, the riser 23 upper elements are prevented from moving relative to the vessel 90. This allows the riser 23 to be suspended from the vessel and, if desired, to be transported from one location to another, such as to avoid a storm at the original location or to commence drilling or well workover and completion operations at another location. The riser 23 may also be secured beneath the floating vessel 90 from the riser stop means 10 during maintenance operations on the riser motion compensating and tensioning means 62, 62A.

Positioned below the riser stop means 10 is a flexible coupling 13 which allows the riser 23 to bend below the bottom of the floating vessel 90 without contacting the vessel 90, during the vessel 90 movement above the wellhead assembly 18, and during riser 23 towing operations.

Figure 5:
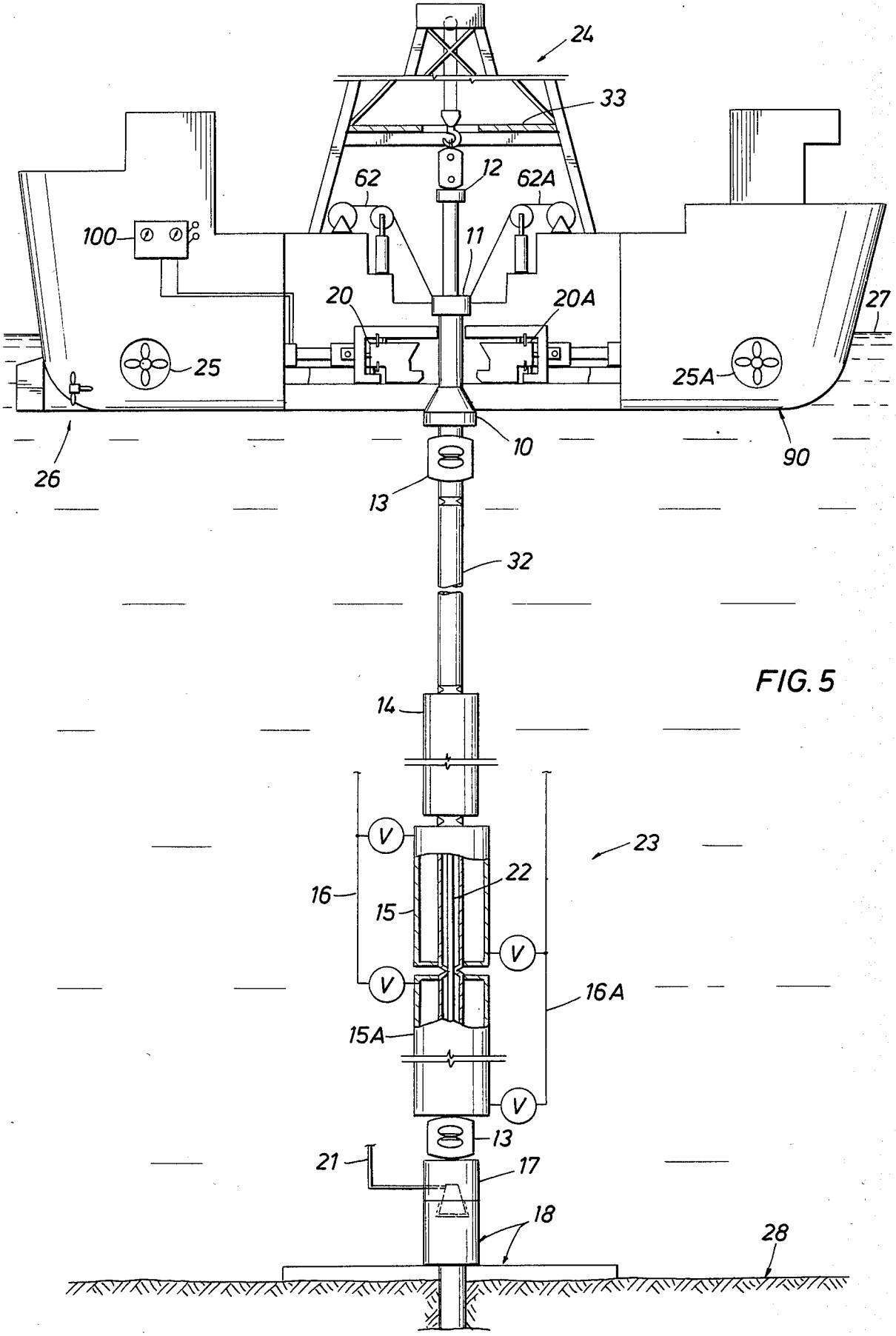
FIG. 5 is a schematic representation of an underwater drilling operation in which a riser, according to the present invention, is shown connected to a new wellhead assembly with additional riser sections added to compensate for the increase in water depth.

Below the flexible coupling 13 is a series of riser 23 sections comprising buoyancy chambers 15, 15A, syntactic foam floats 14 attached to the outer elements of the riser 23, or plain sections with no float mechanisms, 32, (FIG. 5). The buoyancy chambers 15, 15A are capable of having buoyancy adjusting means 29, 29A added or removed from them. Increasing the buoyancy of the riser 23 averts compressive failure of the riser 23 when connected to the wellhead assembly 18. Decreasing the buoyancy reduces the upward vertical forces or "bobbing" tendencies of the riser 23 on the riser locking apparatus while the riser 23 is locked in position beneath the vessel. Buoyancy adjusting control means 16, 16A operated from the offshore vessel 90 are capable of controlling the buoyancy that is added or removed from the buoyancy chambers 15, 15A. A drill string 22 can also be placed within the riser 23 sections for additional ballast while the riser 23 is suspended from the vessel 90 or during towing operations of the riser 23. This drill string 22 is shown in FIG. 2 in a partial cutaway view of the buoyancy chamber 15. The length of the riser 23 may also be altered before commencing towing operations, by the addition or removal of riser sections 14, 15, 15A, 32, (FIG. 5).

Another flexible coupling 13 is located below the ballasting means of the riser 23 and just above a drilling wellhead assembly, 18, which allows the upper portions of the riser 23 to bend relative to the wellhead assembly 18 due to vessel 90 surface movement caused by wind, wave and tide conditions. Typically located below the flexible coupling 13 is the lower end of the riser 23 which incorporates a wellhead connection means 19 of any construction well known to the art which connects or disconnects the riser 23 from the subsea wellhead assembly 18.

Directional positioning thrusters 25, 25A are incorporated below the water line of the floating vessel 90 in order to compensate for normal wind, wave and tide forces imposed upon the floating vessel 90. Vessel motive or propulsion means 26 are used for movement of the floating vessel 90 from one location to another.

As shown also in FIG. 2, the riser locking apparatus is comprised of moveable locking beams 20, 20A which are slidably engaged with the track means 30, 30A. The moveable locking beams 20, 20A slide across the track means 30, 30A by actuation of the moveable locking beams prime mover means 50, 50A shown in this case in the form of pistons and cylinders, though it is recognized that other mechanisms may be used. Locking means in the form of pins 80, 80A are used to lock the moveable locking beams 20, 20A to the tracks 30, 30A at a selected position thereon. Landing areas 31A, 31B, 31C, 31D located on the moveable locking beams 20, 20A form a profile that is required to latch and lock with a mating surface formed by the riser stop means 10.

The riser locking apparatus is preferably controlled by a control panel 100 coupled to a power source and to the various elements of the apparatus. The control panel 100 synchronizes the operation of the beam engagement and locking mechanisms so as to effectively lock or unlock the upper end of the riser 23 from the floating vessel 90. Hydraulic control lines 110A, 110B may be used to supply motive power to the various prime mover means 50, 50A, 59, 59A utilized by the riser locking apparatus. In the preferred embodiment piston and cylinder mechanisms are used to drive and position the moveable locking beams 20, 20A and the riser positioning means 60, 60A. It is recognized that other prime mover or motive means well known to the art may be used, such as a cable and sheave system.

In order to properly locate the riser stop means 10 within the moveable locking beams 20, 20A, the moveable locking beams 20, 20A are closed about the riser 23, and the riser positioning means 60, 60A and the drill string and riser lifting mechanism 34 are used to apply vertical and lateral positioning forces to the upper elements of the riser 23. Riser tensioning and motion compensating means 62, 62A may also be used to apply vertical and lateral positioning forces to the riser 23. The riser positioning means 60, 60A are moved close to one another and locked to the moveable locking beams 20, 20A by locking means such as pins, 58, 58A or any other device well known to the art. This action centers the riser 23 between the landing areas 31A, 31B, 31C, 31D. The riser's inner barrel 12 is fully extended within the riser outer barrel 11 by lifting forces applied by the drill string and riser lifting mechanism 34, and further upward movement raises the riser 23 up through the closed moveable locking beams 20, 20A. These beams 20, 20A resiliently respond to forces generated by the riser stop means 10 contacting the lower elements of the landing areas 31A, 31D separating sufficiently to allow passage of the riser stop means 10 through the landing areas 31A, 31D. As the riser 23 continues its upward movement the landing areas 31A, 31B, 31C, 31D eventually fully mate with the profile surface of the riser stop means 10. At this time the moveable locking beams 20, 20A return to their closest position to one another and are securedly fixed to the tracks 30, 30A by moveable locking beam locking means such as pins 80, 80A well known to the art.

The riser positioning means 60, 60A are shown slideably engaged with the moveable locking beams 20, 20A by use of slideable elements 57, 57A, 57B, 57C, 57D, 57E, such as a roller and track apparatus well known to the art.

Figure 3:
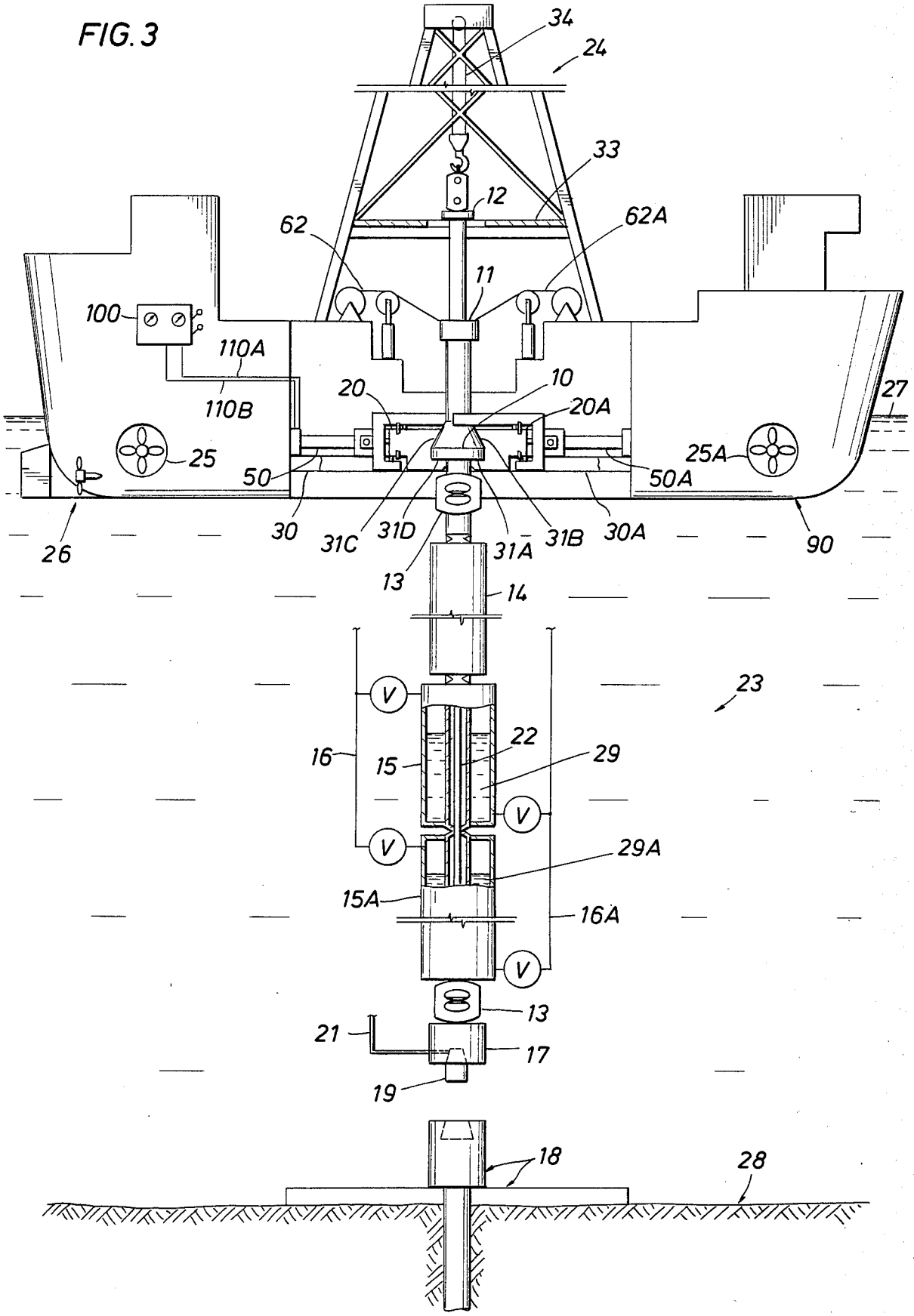
FIG. 3 is a schematic representation of an underwater drilling operation in which a riser assembly, in accordance with the present invention, is shown disconnected from the lower subsea wellhead assembly and locked in position at its upper end by a floating vessel's riser locking apparatus.

FIG. 3 shows the floating vessel 90 and riser 23 in a position to be moved from the original wellhead assembly 18 location. As can be seen, the riser locking apparatus has fixedly engaged the riser stop means 10, the riser 23 in this case having previously been disconnected from the wellhead assembly 18 by operation of the wellhead connection means 19 at the bottom of the riser. Ballast 29, 29A such as sea water may be added to the buoyancy chambers 15, 15A as by flooding, in order to suppress the vertical movement or "bobbing" tendency of the riser 23 within the hull opening of the floating vessel 90. The riser tensioning and motion compensating means 62, 62A and the drill string and riser lifting mechanism 34 have been used to raise the riser 23 within the central hull opening of the vessel 90 in order to engage the landing areas 31A, 31B, 31C, 31D of the moveable locking beams 20, 20A with the cooperating landing areas formed on or incorporated into the riser stop means 10. The riser inner barrel 12 at this time is fully extended outward from the riser outer barrel 11, allowing lifting forces to be applied to the riser 23 from the upward movement of the drill string and riser lifting mechanism 34. The drill string 22 may be removed from the riser 23 prior to moving the vessel 90 from location or it may be left in position within the riser 23 in order to add to the negative buoyancy of the riser assembly if desired. It is also recognized that the riser 23 may be suspended from the vessel 90 in the manner shown in FIG. 3 for an indeterminate length of time.

Figure 4:
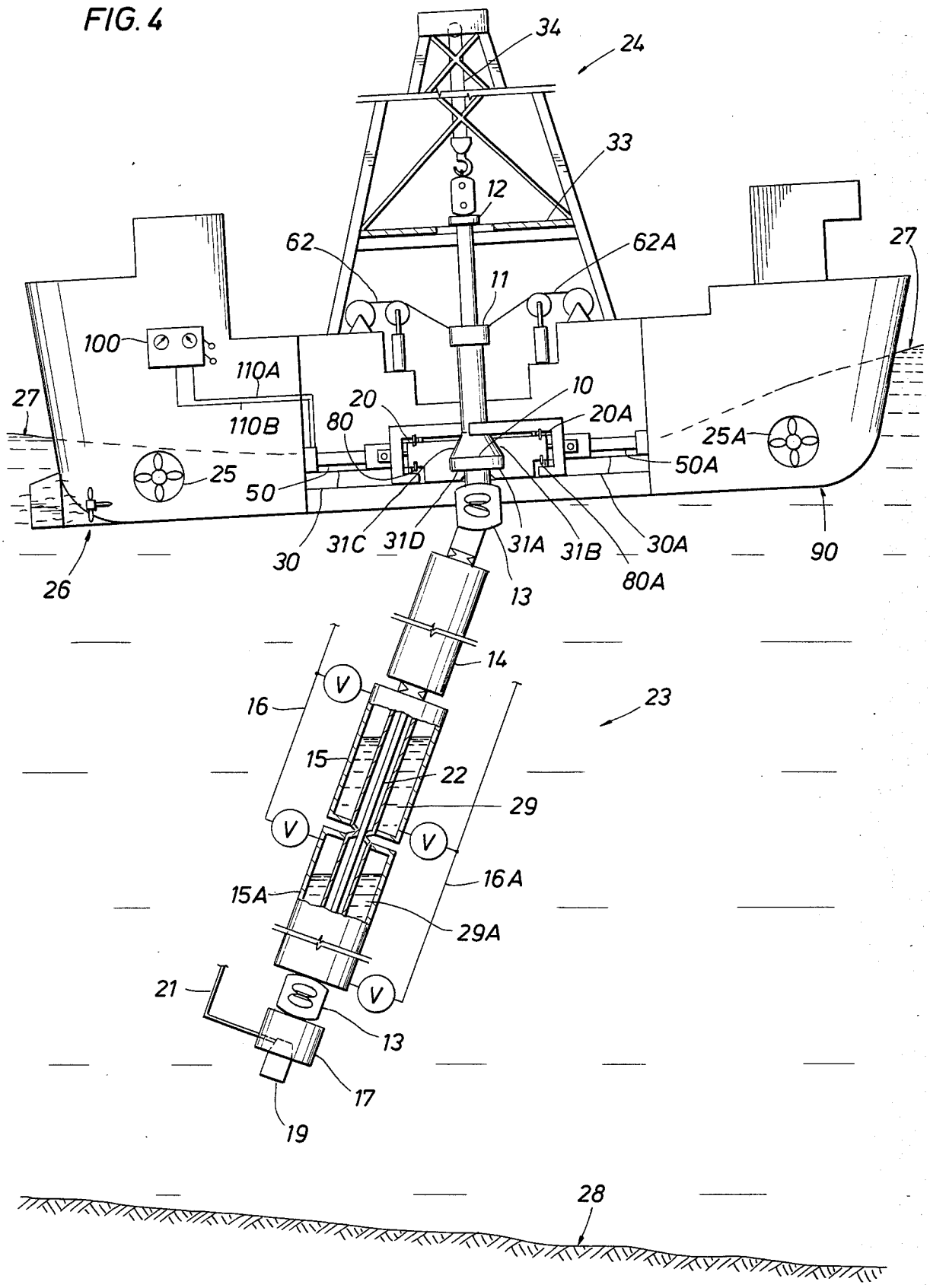
FIG. 4 is a schematic representation of a riser towing operation in which a riser assembly, in accordance with the present invention, is shown being towed from the original drilling location to another location with the upper end of the riser being locked to the vessel by means of the riser locking apparatus.

As shown in FIG. 4, the vessel 90 is now underway using vessel motive or propulsion means 26 in order to move the vessel 90 and the riser 23 away from a storm condition or in order to transport the riser 23 to a new wellhead assembly 18 location, (not shown). The riser assembly 23 can bend at the flexible coupling 13 located beneath the riser stop means 10. The upper end of the riser 23 is prevented from movement relative to the vessel 90 by the engagement of the riser stop means 10 with the landing areas 31A, 31B, 31C, 31D incorporated into the moveable locking beams 20, 20A. At this time the moveable locking beams 20, 20A are securely affixed to the tracks 30, 30A by use of movable locking beam locking means in the form of pins 80, 80A which are operable from a control panel 100. Forces generated by the hydrodynamic imbalances existing between the vessel 90 and the riser 23 may be absorbed entirely by the riser locking apparatus, or a small additional upward force may still be applied by the drill string and riser lifting mechanism 34 or by the riser tensioning and motion compensating means 62, 62A to the upper elements of the riser 23, if storm conditions have not rendered these means inoperative.

As shown in FIG. 5, the vessel 90 has arrived at either a new location or has returned to the original location. The moveable locking beams 20, 20A have been disengaged from the riser stop means 10, and the riser motion compensating and tensioning means 62, 62A now maintain an upward force on the riser 23. The riser inner barrel 12 has returned to its normal telescoping position within the riser outer barrel 11. The riser 23 has been reconnected to the wellhead assembly 18, and drilling operations have been resumed. Additional riser 23 sections 32 may have been added or removed from the riser 23 in order to adjust the height of the riser 23 relative to the derrick room floor 33. Depending on the buoyancy required from the riser 23, these additional riser 23 sections 32 may be syntatic foam float 14, buoyancy chamber 15, 15A or a riser section 32 that does not incorporate any of these buoyancy means. A combination of these sections may be used.

As shown in more detail in FIG. 6, the moveable locking beams 20, 20A are slidably engaged with track 30, 30A positioned on opposite sides of the centrally located hull opening within the floating vessel 90. The riser stop means 10 are centrally positioned, between the moveable locking beams 20, 20A landing areas 31A, 31B, 31C, 31D by riser positioning means 60, 60A which in this embodiment is made up of two slides engaged with the moveable locking beams 20, 20A. Lateral movement limiting means which may be in the form of tracks 61, 61A prevent the moveable locking beams 20, 20A from moving perpendicular to the longitudinal axis of the tracks 30, 30A. The moveable locking beams 20, 20A can be locked in either the stowed position, or the riser 23 locking position, by the use of moveable locking-beam locking means such as by pins 80, 80A, 80B, 80C well known to the art. The riser positioning means 60, 60A are locked to the moveable locking beams 20, 20A by means of riser positioning means locking means such as by pins 58, 58A well known to the art.

A hydraulic accumulator 120 containing hydraulic fluid in contact with a resilient gas 121, pump 130, and reservoir 140 may be included as part of the control system in order to supply hydraulic fluid under pressure for operation of the various prime mover means and locking means. The resilient gas 121 cushion above the hydraulic fluid allows the moveable locking beams 20, 20A to resiliently resist forces generated by contact with the riser 23 or riser stop means 10. It is recognized that, whereas these components are shown linked to the same hydraulic line prior to their connection with a control panel 100, each component may also be independently connected to a control panel 100. Hydraulic control lines 110A, 110B, may also be connected to their respective components in any manner known to the art, though they are shown connected in a parallel manner to the components shown in FIG. 6, FIG. 7, and FIG. 8.

Figure 7A:
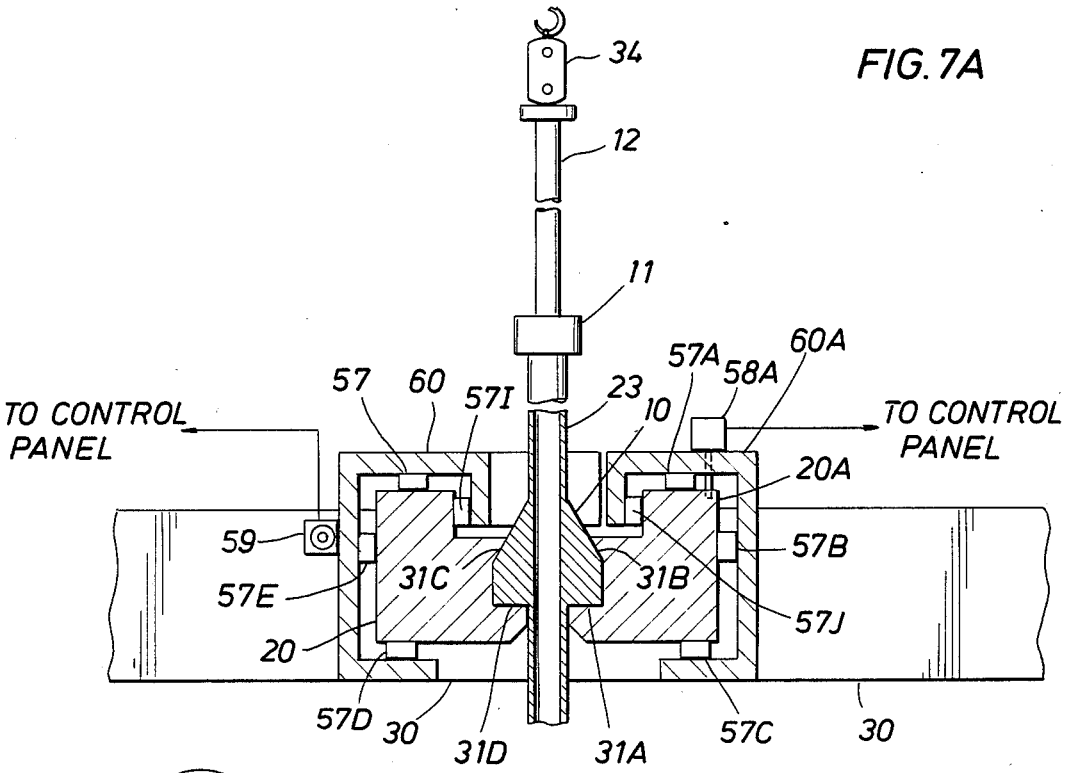
FIG. 7A is a schematic partial view in cross section taken along lines 7A—7A of FIG. 6 further illustrating the riser stop means and riser positioning systems.
Figure 7B:
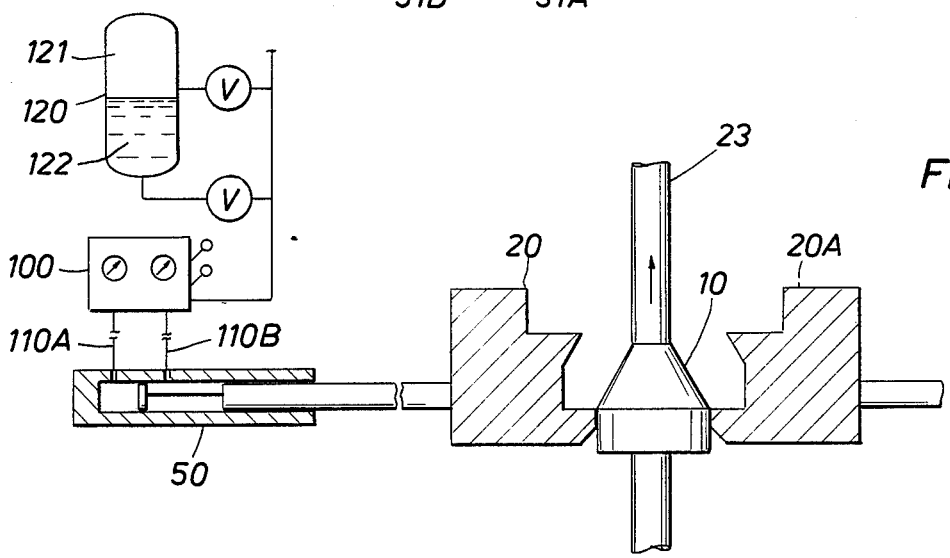
FIG. 7B shows the riser stop means outer elements contacting the moveable locking beams(s) landing areas.
Figure 7C:
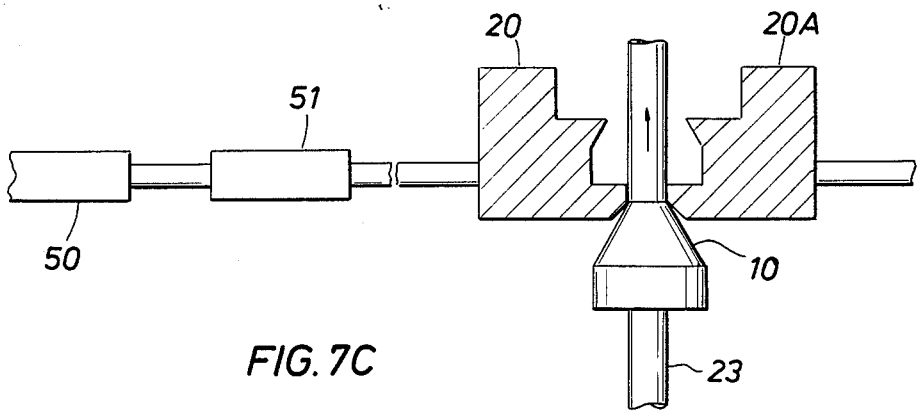
FIG. 7C shows the riser stop means positioned below the moveable locking beams.
Figure 7D:
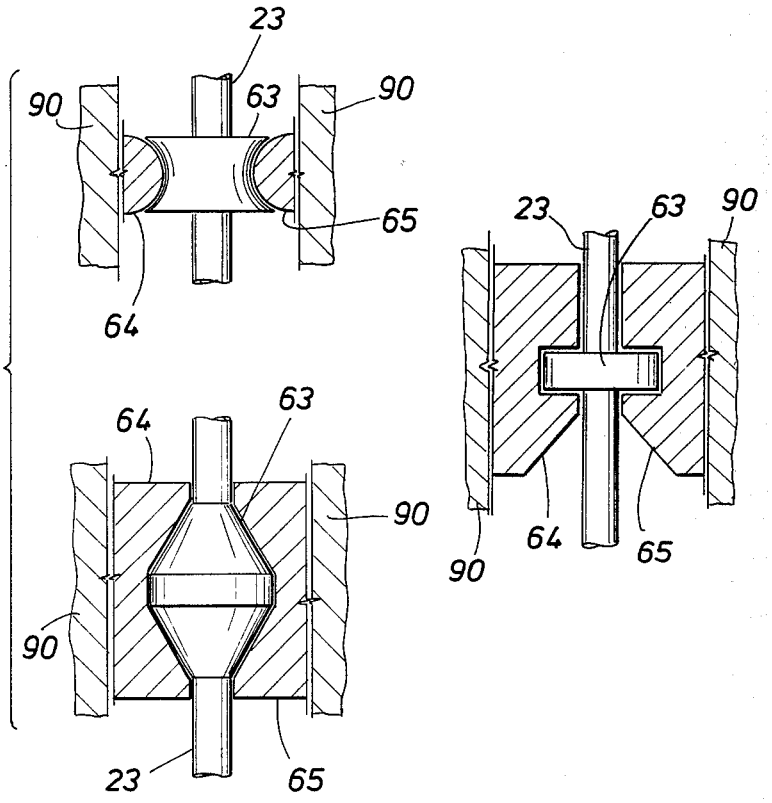
FIG. 7D shows alternate geometric configurations of the riser stop means and landing area.

FIGS. 7A, 7B, and 7C show the operation of latching and locking the riser stop means 10 to the landing areas 31A, 31B, 31C, 31D of the moveable locking beams 20, 20A. As shown in the sequence of FIGS. 7C, 7B, and 7A, the riser 23 and its incorporated riser stop means 10, travel upward between the moveable locking beams 20, 20A. These beams 20, 20A are located in their closest position to each other at the start of the latching and locking operation, as shown in FIG. 7C. Riser positioning means 60, 60A in the present embodiment, have been actuated to position the riser 23 between landing areas 31A, 31B, 31C, 31D, (FIG. 7A) and have been locked in position by pins 58, 58A (58 not shown) on the moveable locking beams 20, 20A. As the riser 23 is raised between the beams 20, 20A, the beams 20, 20A resiliently follow the contour of the riser stop means 10, as shown in FIG. 7B.

In the present embodiment these resilient means include a hydraulic accumulator 120 partially filled with a resilient gas 121, wherein the movement of the moveable locking beams 20, 20A causes the hydraulic fluid 122 within the accumulator 120 to rise, thereby compressing the resilient gas 121. The compressibility of this gas 121 effectively causes the moveable locking beams 20, 20A to maintain contact with the contour of the riser stop means 10, as it rises between these beams 20, 20A. As the riser stop means 10 is raised further the beams 20, 20A will return to their normal locking position around the riser stop means 10, as shown in FIG. 7A, whereupon the riser 23 will no longer be lifted by the drill string and riser lifting apparatus 34. At this time, the moveable locking beams 20, 20A will be securedly fixed to the tracks 30, (30A not shown), and the riser 23 will thereby become secured by the riser locking apparatus to the floating vessel 90.

The resilient means 120, 121, 122 shown in FIG. 7B is not the only mechanism available to achieve the same mechanical effect as discussed above. As shown in FIG. 7C, the resilient means may take the form of resilient spring means 51 connectably engaged between the second prime mover means 50 and the moveable locking beam 20, the spring means 51 comprised of resilient material well known to the art, such as rubber or elastomer mouldings, spring coils, or even a hydraulic piston and cylinder arrangement with a resilient pressure source entrained between the piston and cylinder. It is recognized that these resilient spring means 51 may also be located between the vessel 90 and the second prime mover means 50. Although resilient means 51 such as discussed above are not currently incorporated into the operation of the riser positioning means 60, 60A in the present embodiment, it is recognized that other embodiments of the present riser locking apparatus may include such resilient means.

FIG. 7A also shows the riser positioning means 60, 60A slidably engaged with the moveable locking beams 20, 20A by the use of slideable engagement means, such as co-operating rotatable elements 57, 57A, 57B, 57C, 57D, 57E, 57I, 57J carried within guide tracks (not shown) as in well known in the art.

FIG. 7D shows two other possible riser stop means 63 and landing area 64, 65 combinations, though not embodied in the present invention. It is recognized that other geometric configurations may also be developed in anticipation of different riser stop means 63 and landing area 64, 65 loading and latching conditions.

FIG. 8 shows in detail one form of the moveable locking beams 20A connection to the track 30A, the track 30A correspondingly being fixed to the vessel 90. Slidable elements 57F, 57G, 57H are shown rotatably engaged between the moveable locking beam 20A and the track 30A in such a way as to prevent vertical movement upwards or downwards and lateral movement of the moveable locking beam 20A other than along the track 30A. A moveable locking beam locking device, which may be in the form of a remotely-actuatable pin 80B, is shown engaged with the lateral movement limiting means guide track 61A, which is carried by the track 30A. It is recognized that other locking device locations may be used. The riser stop means 10 is shown positioned by the riser positioning means 60, 60A, which are shown locked in position by the riser positioning means locking means 58, 58A, which may be in the form of remotely actuatable pins, operated by a control panel 100.

It is recognized that other track 30A and moveable locking beam 20A configurations may be used.

We claim as our invention:

1. For use in a floating vessel having a substantially centrally-positioned vertical hull opening therethrough, and said vessel being provided with well drilling equipment, including an elongated vertical riser provided with riser stop means carried outwardly near upper end thereof, flexible coupling means in said riser below the stop means thereof and buoyancy adjusting means on the submerged portion of said riser, said riser extending in tension substantially centrally down through said hull opening to a point adjacent the ocean floor, and motion-compensating and tensioning means carried by said vessel operatively connected to said riser for vertically supporting said riser during normal operations, said improvement comprising auxiliary riser locking means apparatus carried by said vessel substantially within the plan view cross section of the hull opening through the vessel, said locking means apparatus comprising:

at least two track means arranged in spaced relationship on opposite sides of and within said hull opening, and being connected to said vessel, at least a pair of moveable locking beams supported at each end by each of said track means and positioned to span opposite portions of said hull opening, and being moveable towards each other, vertical movement-limiting means engageable with said locking beams and operatively connected to said vessel adjacent said track means to prevent vertical movement of said moveable locking beams away from said track means, at least one landing area carried by each of said moveable locking beams, said landing areas being engageable with at least a portion of said riser stop means, at least a pair of riser-positioning means, each one being operatively connected between said riser and said vessel, and being moveable relative to each other and to the landing areas of said moveable locking beams to selectively position said riser within said hull opening of said vessel, first prime mover means carried by said vessel and operatively connected to said pair of riser positioning means for selectively moving said riser-positioning means, second prime mover means carried by said vessel and operatively connected to said moveable locking beams for selectively moving said beams, and resilient means carried by said vessel and operatively connected to at least one of said prime mover means.

2. The apparatus of claim 1 wherein said resilient means are operatively connected to said first prime mover means.

3. The apparatus of claim 2 wherein said first prime mover means comprises at least one hydraulic cylinder having a housing member operatively attached to said vessel, a moveable piston dividing the housing member into two hydraulic chambers, rod means connected to said piston and coupled to said riserpositioning means, and pressure source means operatively engaged to said hydraulic chambers for moving said riser-positioning means in alternate directional modes in response to pressurization of alternate hydraulic chambers by said pressure source means.

4. The apparatus of claim 3 wherein said pressure source means comprises a hydraulic accumulator containing a source of hydraulic fluid in contact with a pressurized resilient gas, to allow movement of said riser-positioning means in a first directional mode while resiliently resisting movement opposite said first directional mode.

5. The apparatus of claim 2 wherein said resilient means comprises a hydraulic reservoir containing a hydraulic fluid, one surface of said fluid in contact with a resilient gas, another surface in contact with a piston forming one end of said reservoir, said piston operatively connected to said first prime mover means, to allow forces imposed on said piston by said first prime mover means to be resiliently resisted by said gas.

6. The apparatus of claim 1 wherein said resilient means is interposed between said first prime mover means and said riser-positioning means.

7. The apparatus of claim 6 wherein said resilient means comprises spring means operatively connected between said first prime mover means and said riser positioning means.

8. The apparatus of claim 1 wherein said resilient means are operatively connected to said second prime mover means.

9. The apparatus of claim 8 wherein said second prime mover means comprises at least one hydraulic cylinder having a housing member operatively attached to said vessel, a moveable piston dividing the housing member into two hydraulic chambers, rod means connected to said piston and coupled to said moveable locking beams, and pressure source means operatively engaged to said hydraulic chambers, for moving said moveable locking beams in alternate directional modes in response to pressurizations of alternate hydraulic chambers by said pressure source means.

10. The apparatus of claim 9 wherein said pressure source comprises a hydraulic accumulator, containing a source of hydraulic fluid in contact with a pressurized resilient gas, to allow movement of said moveable locking beams in a first directional mode while resiliently resisting movement opposite said first directional mode.

11. The apparatus of claim 8 wherein said resilient means comprises a hydraulic reservoir containing a hydraulic fluid, one surface of said fluid in contact with a resilient gas, another surface in contact with a piston forming one end of said reservoir, said piston operatively connected to said second prime mover means, to allow forces imposed on said piston by said second prime mover means to be resiliently resisted by said gas.

12. The apparatus of claim 1 wherein said resilient means is interposed between said second prime mover means and said moveable locking beam.

13. The apparatus of claim 12 wherein said resilient means comprises spring means operatively connected between said second prime mover means and said moveable locking beams.

14. The apparatus of claim 1 wherein said track means are substantially horizontal.

15. The apparatus of claim 1 wherein said track means include a pair of tracks on opposite sides of said hull opening, one member of each pair being positioned vertically above and remaining parallel with the other member of the pair, both pair of tracks having the same relative elevation with the other pair on the opposite side of the hull opening.

16. The apparatus of claim 15 wherein each end of said moveable locking beams is positioned between an upper track and a lower track, and each end includes track engaging means formed by upward and downward facing surfaces of said moveable locking beam, said track engaging means being engageable with said upper and lower track.

17. The apparatus of claim 1 wherein said pair of moveable locking beams moving equally toward and away from each other.

18. The apparatus of claim 1 wherein said moveable locking beams when in closest proximity to one another, are in closest proximity to said riser stop means location.

19. The apparatus of claim 1 wherein said moveable locking beams include lateral movement-limiting means carried between said moveable locking beams and said track means, said lateral movementlimiting means formed by co-operating elements, one of said elements being arranged parallel to the longitudinal axis of said track means, another of said elements moveably engaged with said longitudinally arranged element, both elements preventing movement of said beams in a direction perpendicular to the longitudinal axis of said tracks.

20. The apparatus of claim 1 wherein said moveable locking beams includes locking means engageable with said track means for fixedly securing said moveable locking beams to said track means.

21. The apparatus of claim 20 wherein said moveable locking means includes prime mover means, for engaging said locking means between said track means and said moveable locking beams, to lock said moveable locking beams to said track means.

22. The apparatus of claim 1 wherein the vertical movement limiting means includes a downwardly facing surface formed on said track means and being vertically displaced above a cooperating upwardly facing surface of said moveable locking beams, said downwardly facing surface in substantially close proximity to said upwardly facing suface so as to prevent substantial vertical upward movement of said beam relative to said track means.

23. The apparatus of claim 1 wherein the vertical movement limiting means includes an upwardly facing surface formed on said track means and being vertically displaced below a correspondingly downwardly facing surface of said moveable locking beams, said upward facing surface being in substantially close proximity to said downwardly facing surface, so as to prevent substantial vertical downward displacement of moveable locking beam relative to said track means.

24. The apparatus of claim 22 or claim 23 wherein said downward facing surface slideably engages said upward facing surface.

25. The apparatus of claim 1 wherein said landing areas are located in a face-to-face manner on adjacent sides of said moveable locking beams.

26. The apparatus of claim 1 wherein said riser positioning means further comprises at least a pair of riser positioning means each one operatively connected with each moveable locking beam to prevent perpendicular movement of said riser positioning means relative to the longitudinal axis of said moveable locking beams, said riser positioning means being moveable relative to each other.

27. The apparatus of claim 1 wherein the riser positioning means further includes riser-positioning means locking means, for locking said riser positioning means to said moveable locking beams.

28. The apparatus of claim 27 wherein said riser positioning means locking means includes prime mover means, for engaging said locking means between said moveable locking beams and said riser positioning means, to lock said riser positioning means to said moveable locking beams.

29. The apparatus of claim 1 wherein said riser-positioning means when in closest spaced relationship to one another, are in closest proximity to said riser stop means location.

30. A method of fixedly securing the elements forming the upper end of a riser to a floating vessel having a substantially centrally-positioned vertical hull opening therethrough, said vessel provided with well drilling equipment, including a derrick with associated drill string lift equipment, an elongated vertical riser provided with riser stop means carried outwardly near said riser upper end thereof, a wellhead connector carried at the lower end of said riser and secured to a wellhead assembly, flexible coupling means in said riser below the stop means thereof, and adjustable buoyancy means formed with the submerged portion of said riser, said riser extending in tension during normal operations substantially centrally down through said hull opening to a point adjacent a wellhead assembly located adjacent the ocean floor, said vessel carrying motion-compensating and tensioning means operatively connected to said riser upper elements for vertically supporting said riser during normal operations, and provided with riser locking means apparatus including a pair of locking beams on tracks connected to said vessel; said locking beams carrying a pair of riserpositioning means to position said riser between said beams, said method comprising:

remotely disconnecting the wellhead connector at the lower end of said riser from said welhead assembly, moving said moveable locking beams along said track means toward each other, until each beam is in close spaced relationship with each other beam, moving said riser-positioning means along said moveable locking beams toward each other, thereby contacting and subsequently positioning said riser in the center of the hull opening, actuating said floating vessel's riser motion compensating and tensioning means, and said drill string lift equipment, thereby raising said riser between said closely spaced moveable locking beams, thereby engaging said moveable locking beams resiliently with said riser stop means, latching said riser stop means with said moveable locking beams in a weight supporting manner, to prevent movement of riser upper elements relative to said vessel.

31. The method claim 30, including the steps of adjusting the buoyancy of said riser by adding and removing adjustable buoyancy means from said riser.

32. The method of claim 30, including the steps of transporting said floating vessel with said securedly fixed riser to another location, moving said moveable locking beams along said track means away from each other to disengage said locking beams from said riser stop means, adjusting height of riser for connection to a second wellhead assembly, lowering said riser onto said second wellhead assembly, and connecting riser wellhead connector to said wellhead assembly.

33. The method of claim 30 including the step of suspending said riser beneath said floating vessel.

34. The method of claim 33 including the step of suspending said riser beneath said floating vessel during repair and maintenance operations on said vessel's motion compensation and tensioning equipment.

35. Riser locking means apparatus carried by a vessel substantially within the plan view cross section of a vertical hull opening through said vessel, for fixedly locking the upper end of a riser to said floating vessel so as to prevent movement of said upper end of said riser relative to said floating vessel within said vertical hull opening therein, said riser provided with riser stop means carried outwardly near the upper end thereof, said riser locking means apparatus operatively connectable between said vessel and said riser, said riser locking means apparatus comprising:

at least two track means arranged in spaced relationship on opposite sides of and within said said hull opening, and being connected to said vessel, at least a pair of moveable locking beams supported at each end by each of said track means and positioned to span opposite portions of said hull opening, and being moveable towards each other, vertical movement-limiting means engageable with said locking beams and operatively connected to said vessel adjacent said track means to prevent vertical movement of said moveable locking beams away from said track means, at least one landing area carried by each of said moveable locking beams, said landing areas being engageable with at least a portion of said riser stop means, at least a pair of riser-positioning means, each one being operatively connected between said riser and said vessel, and being moveable relative to each other and to the landing areas of said moveable locking beams to selectively position said riser within said hull opening of said vessel, first prime mover means carried by said vessel and operatively connected to said pair of riser positioning means for selectively moving said riser-positioning means, second prime mover means carried by said vessel and operatively connected to said moveable locking beams for selectively moving said beams, and resilient means carried by said vessel and operatively connected to at least one of said prime mover means.

* * * * *